US008099965B2

(12) United States Patent
Stelmach

(10) Patent No.: US 8,099,965 B2
(45) Date of Patent: Jan. 24, 2012

(54) COLD PROBE FOR COOLING LIQUIDS

(76) Inventor: John Stelmach, Prescott, AZ (US)

( * ) Notice: Subject to any disclaimer, the term of this patent is extended or adjusted under 35 U.S.C. 154(b) by 728 days.

(21) Appl. No.: 12/250,097

(22) Filed: Oct. 13, 2008

(65) Prior Publication Data

US 2010/0089087 A1 Apr. 15, 2010

(51) Int. Cl.
*F25B 21/02* (2006.01)

(52) U.S. Cl. ..... 62/3.2; 62/126; 62/129

(58) Field of Classification Search ..... 62/3.2, 62/3.64, 3.7, 56, 293, 126, 129; 426/592
See application file for complete search history.

(56) References Cited

U.S. PATENT DOCUMENTS

| | | | | |
|---|---|---|---|---|
| 3,220,450 | A | 11/1965 | Aronson | |
| 5,368,384 | A | 11/1994 | Duncan | |
| D369,502 | S | 5/1996 | Albertson | |
| 5,537,825 | A * | 7/1996 | Ward | 62/3.64 |
| 6,210,032 | B1 | 4/2001 | Murphy | |
| 6,318,247 | B1 | 11/2001 | Di Nunzio | |
| 6,338,570 | B1 | 1/2002 | Santacruz-Olivares | |
| 6,763,672 | B1 * | 7/2004 | Anderson et al. | 62/289 |
| 7,596,956 | B2 * | 10/2009 | Lilke | 62/3.6 |
| 2003/0161933 | A1 * | 8/2003 | Anderson et al. | 426/592 |
| 2005/0105386 | A1 | 5/2005 | Crites | |

* cited by examiner

*Primary Examiner* — Mohammad Ali
(74) *Attorney, Agent, or Firm* — Sturm & Fix LLP

(57) ABSTRACT

A chilled probe for quickly and conveniently cooling a liquid is positioned to permit a user to insert the probe into the liquid to be cooled. Feedback, in the form of an indication of a representative liquid temperature, is also provided to increase the value of the method and apparatus. Individual sleeves are conveniently provided on a roll to keep the chilled probe from coming into direct contact with the liquid, thereby avoiding contamination between liquid samples being cooled.

5 Claims, 5 Drawing Sheets

Fig. 4
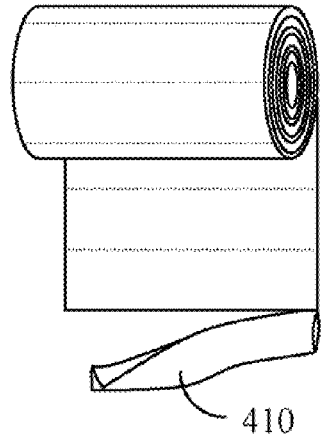
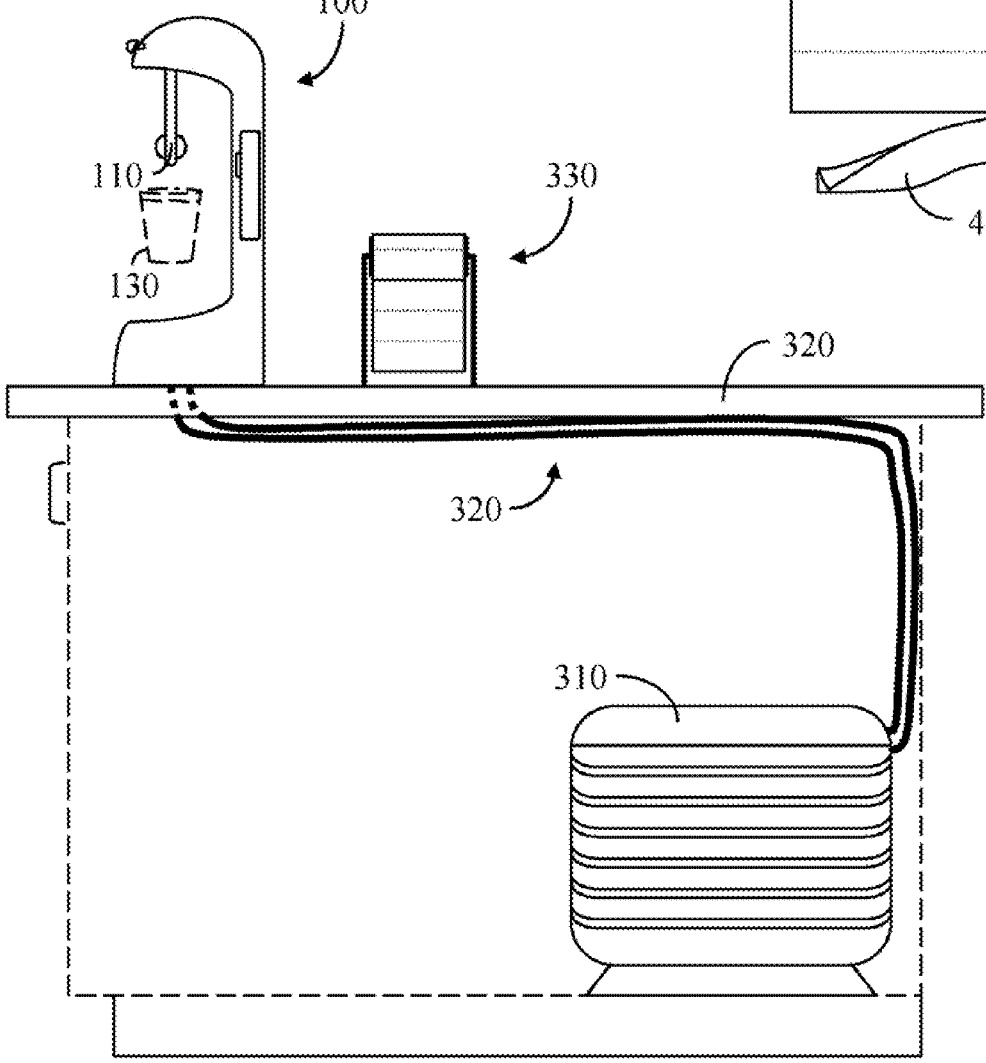
Fig. 3

COLD PROBE FOR COOLING LIQUIDS

CROSS REFERENCE TO RELATED APPLICATIONS

Not applicable.

BACKGROUND OF THE INVENTION

1. Field of the Invention

The present invention relates generally to a cooling device. More particularly the present invention relates to a method and apparatus for conveniently reducing a temperature of a liquid such as a hot drink or a laboratory specimen.

2. Background Art

Hot drinks are frequently served too warm for comfortable immediate consumption. Consumers of such drinks are accustomed to wait, and blow their breath over the free surface of the hot drink until it has cooled sufficiently to consume comfortably.

In laboratories, warm fluids are cooled in refrigerators and freezers, both having limited capacity to cool these fluids quickly.

For the above reasons, there is a need for a method and apparatus for quickly and conveniently cooling warm or hot fluids.

BRIEF SUMMARY OF THE INVENTION

An object of the present invention is to provide a method and apparatus for quickly and conveniently cooling quantities of liquids. Another object of this invention is to provide a method and apparatus for avoiding contaminating liquid samples cooled successively. Still another aspect of the present invention is to provide feedback to a user of the chilled probe, indicating a temperature of the liquid.

The present invention comprises a chilled probe mounted in a convenient position for inserting into a cup, beaker, or similar container of liquid. The probe is chilled, that is: its temperature reduced, using one (or more) of several refrigeration techniques, and shall have sufficient capacity to cool or chill the liquid at a rate specified for the application. The present invention is not limited to a particular refrigeration technique or cycle.

Such an apparatus may be set up at a counter in a fast food restaurant or convenience store where customers are wont to purchase coffee, tea, hot chocolate or the like. After the drink has been dispensed and/or served to the customer, said customer may slide a disposable, protective sleeve over the probe to avoid contaminating the drink with other, previously cooled drinks, and to avoid contaminating later cooled drinks. The customer then positions the chilled probe in the hot drink for a brief period of time, until the drink has reached a temperature with which the customer is comfortable. An indication of the liquid temperature is displayed on the unit so the customer knows when to cease cooling the liquid. A representative liquid temperature may be sensed by a sensor immersed in the liquid along with the chilled probe, or by a laser sensor mounted to detect the temperature of the liquid at a point on the liquid's surface.

A similar application is at a soup and salad bar, where consumers serve themselves hot soup. The probe, with its protective sleeve, is again used to cool the soup to a comfortable temperature.

Another application for the instant invention presents itself in medical or chemical labs, or similar. Relatively small samples of blood, urine, or other bodily fluids, as well as chemicals may be at higher temperatures than are ideal for the process through which they must be brought. These fluids may be chilled quickly and conveniently using the present invention. Contamination may be avoided by the use of the aforementioned disposable sleeve. The temperature indicator may be used to determine when the sample has achieved the desired temperature.

The novel features believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings and examples are for the purpose of illustration and description only, and not intended in any way as a definition of the limits of the invention.

BRIEF DESCRIPTION OF THE SEVERAL VIEWS OF THE DRAWINGS

FIG. 3 is a view of the cold probe assembly, mounted on a counter and cooled with a remote refrigeration unit;

FIG. 4 is a perspective view of a roll of disposable, protective sleeves to be installed over the cold probe;

DETAILED DESCRIPTION OF THE INVENTION

Figure 1:
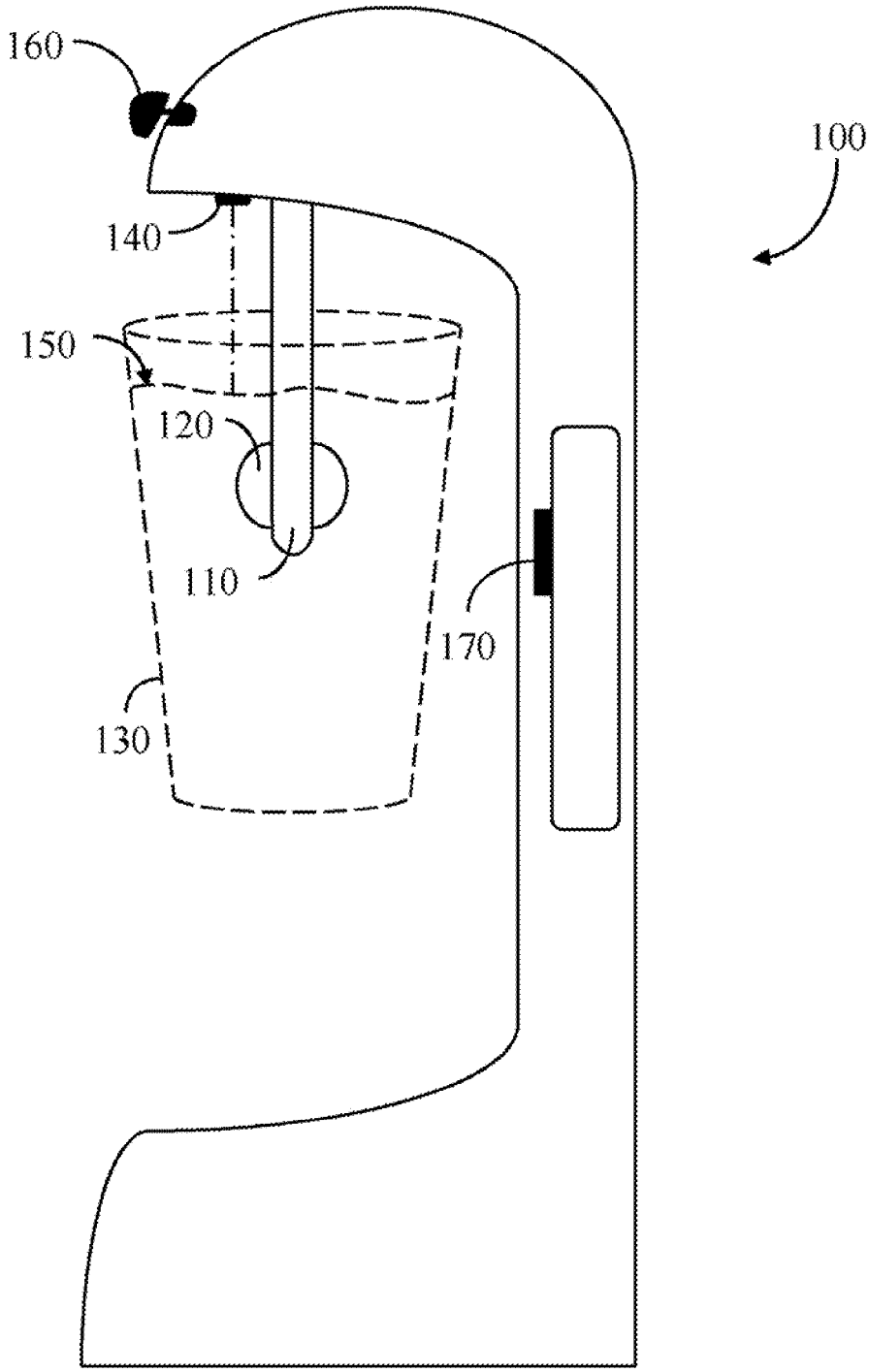
FIG. 1 is a side elevation view of a cold probe assembly of the present invention.
Figure 2:
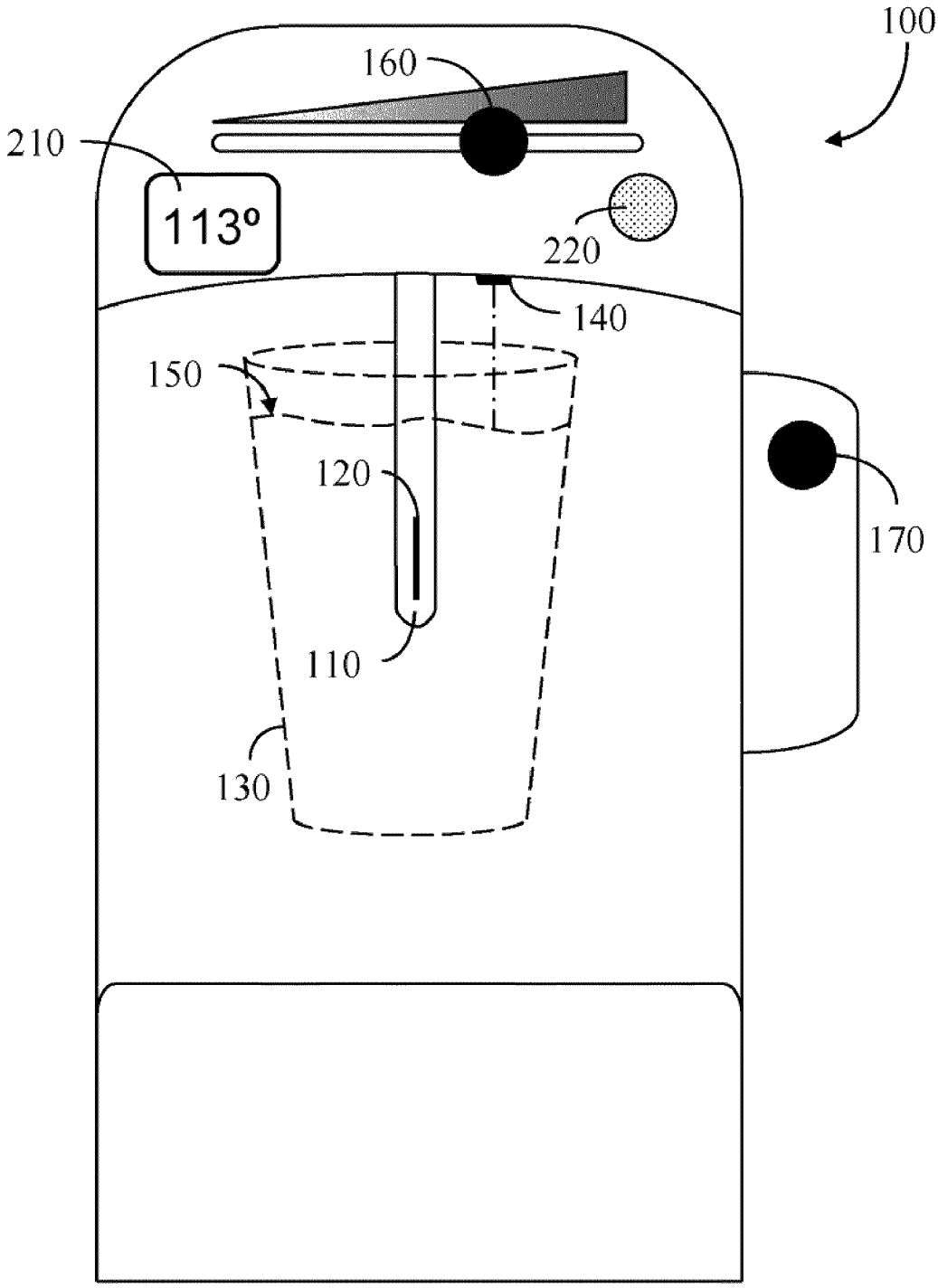
FIG. 2 is an elevation view from the front of the cold probe assembly.

A cold probe assembly 100 is depicted in FIGS. 1-3. A temperature of a probe 110 is reduced using a refrigeration cycle, such as a vapor compression refrigeration cycle using a liquid/vapor refrigerant; a gas refrigeration cycle using a gaseous refrigerant; an absorption refrigeration cycle using at least a binary mixture; the Peltier effect; or one of the more recent advances, such as the magnetic refrigeration cycle using a solid refrigerant. A chilled liquid, such as liquid nitrogen may also be used in lieu of a refrigeration cycle to chill the probe 110. The choice of chilling process may hinge on the cooling needs of the application for which the cold probe assembly is used. The present invention is not limited to a particular chilling process. Refrigeration cycles are covered in many undergraduate thermodynamics textbooks such as *Fundamentals of Engineering Thermodynamics* $6^{th}$ ed. by Moran and Shapiro, John Wiley & Sons, Inc., publishers, ISBN-13: 978-0471-78735-8 which is hereby incorporated in its entirety by reference.

The probe 110 is inserted into a liquid for the purpose of reducing the liquid's temperature. The probe 110 is preferably fitted with fins 120 to increase a surface area for heat exchange. Additionally, the fins may be arranged to enhance turbulence when a user moves a cup 130 while the probe 110 is in the liquid inside the cup. Turbulence in the fluid enhances heat transfer from the liquid to the probe 110.

A temperature sensor 140 is disposed to provide an indication of the fluid temperature 210 to the user of the cold probe assembly 100. The temperature sensor 140 may be a remote sensor, such as a laser sensor, mounted to read the temperature of a liquid surface 150. Alternatively, the sensor may comprise a contact sensor 510 (see FIG. 5), such as a thermocouple or thermister mounted on the probe 110 and thermally isolated therefrom. Other types of temperature sensors and other locations for the temperature sensor are possible, and the present invention is in no way limited to a particular temperature sensor type or location.

The indication of the fluid temperature 210 may be a digital readout, as shown, or a color change—such as from red to blue—or a light or series of lights to convey to a user when to cease cooling the liquid. An audible signal emanating from a tone generator 220 may also be used.

A temperature control adjustment 160 may be available for adjusting the temperature set point of the probe 110. In this way, too rapid and too slow cooling, and also icing can be avoided. A thermostat, using the set point from the temperature control adjustment 160 and a signal from the temperature sensor 140, may be provided to automatically cease chilling the probe 110.

A remote refrigeration unit 310 is shown under a counter 320 in FIG. 3. It may not be necessary for the refrigeration unit 310 to be remote from the cold probe assembly 100 for at least some applications. However, when rapid cooling, extreme low temperatures are needed, and/or a large cooling load (i.e. many cups in a short time) is likely, the remote refrigeration unit 310 may be provided. Lines 320 carry refrigerant or other chilled fluid to the probe 110 at adequately low temperature and flow rate for the application for which the cold probe assembly 100 is used.

Figure 5:
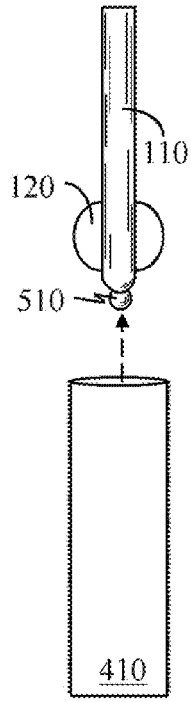
FIG. 5 is a side elevation view of a probe having a temperature sensor and a sleeve disposable over the probe.

Disposable sleeves 410 are shown in a roll 330 in FIGS. 3 and 4. The sleeve 410 is removed from the roll 330 by tearing at perforations provided between the individual sleeves 410. The sleeve 410 is then slid over the probe 110, as illustrated in FIG. 5, by the user to keep the probe 110 from contaminating the fluid being cooled, and to keep the fluid from contaminating the probe 110. After use, the sleeve 410 is thrown away.

The cold probe assembly may be energized continuously for some applications. That is, the probe 110 may be kept at a low, operating temperature at all times. Alternatively, a button 170 may be provided so a user may initiate the process of bringing the temperature of the probe 110 down.

Figure 6:
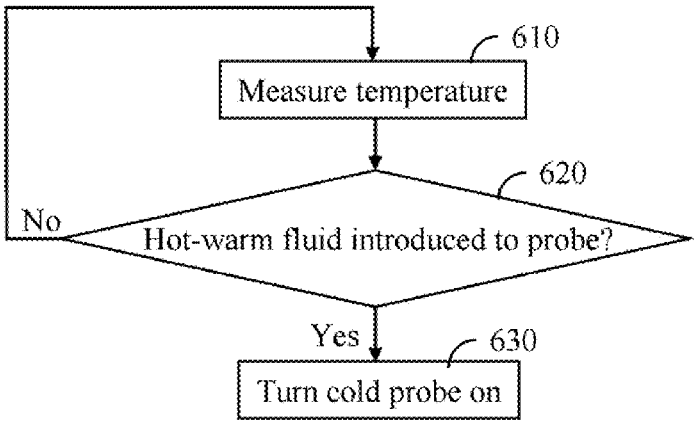
FIG. 6 is a flow diagram of a first logic sequence.

Still another alternative is for the cold probe assembly to recognize when a hot or warm liquid is introduced, as shown in FIG. 6. A temperature reading 610 is made periodically using the laser sensor 140 or the direct contact sensor 510, or another sensor technology is employed. The resulting temperature is compared to a threshold value, preferably greater than the ambient, as shown in the comparator block 620. If the sensor 140, 510 does not sense a warm fluid, no further action is taken and another temperature reading 610 is taken at an appropriate time.

If a warm or hot fluid is sensed, the cold probe assembly is activated 630, thereby cooling the probe 110.

Figure 7:
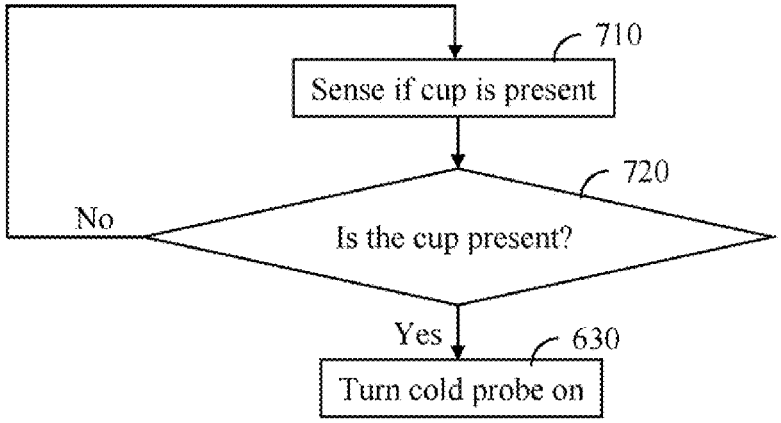
FIG. 7 is a flow diagram of a second logic sequence.

Another energizing strategy, shown in FIG. 7, is to sense the presence of the cup 130, indicated in the sensing block 710, using an infrared sensor or the like. A decision is made in block 720 whether the cup is present, and if it is not, no further action is taken and another sensor reading is taken in the sensing block 710 at an appropriate time. If the cup is sensed, the cold probe assembly is activated 630, thereby cooling the probe 110.

Figure 8:
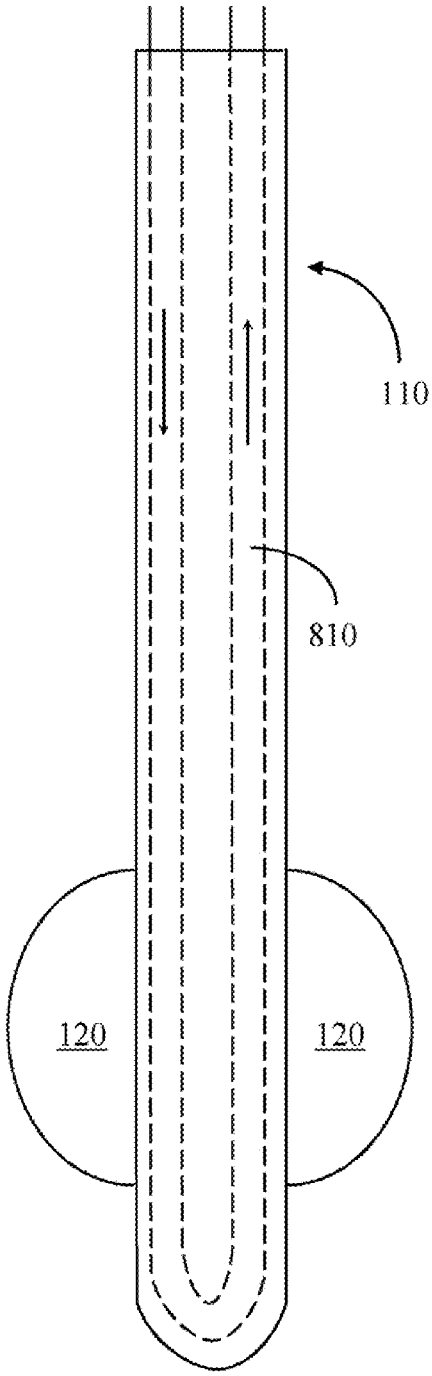
FIG. 8 is a side elevation view of the probe with flow passages.
Figure 9:
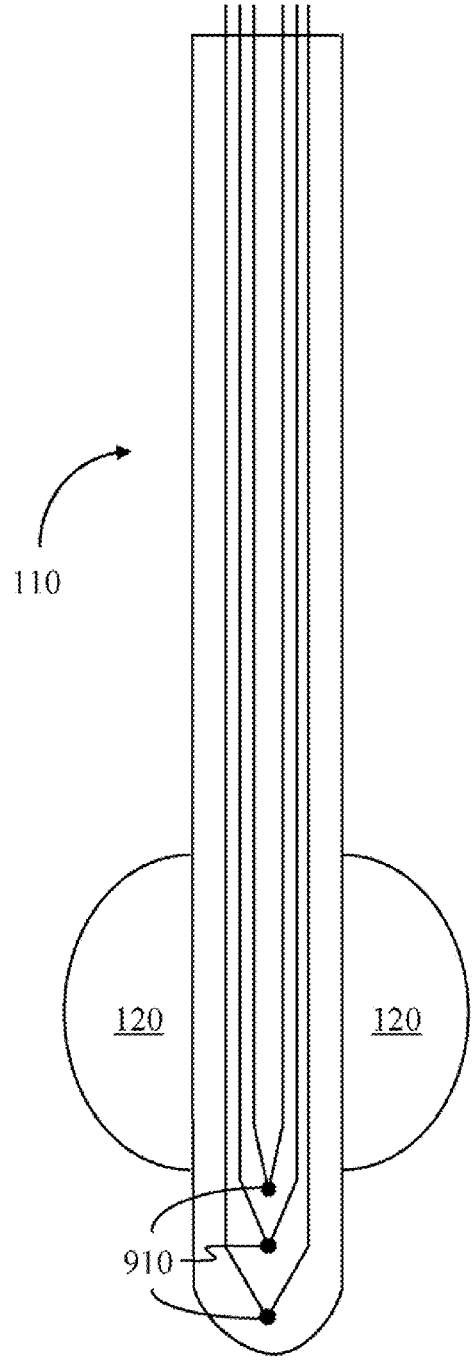
FIG. 9 is a side elevation view of the probe with Peltier junctions.

Two approaches to removing heat from the probe 110 are shown in FIGS. 8 and 9. In FIG. 8, passages 810 are formed in the probe to permit a chilled fluid to pass through the probe 110 and pick up heat from the probe while heat from the liquid is transferring to the probe.

In FIG. 9, a plurality of Peltier junctions 910 are shown. The Peltier junctions 910 are energized while the probe 110 is in the fluid, and heat is transferred to the probe 110 from the fluid. The heat transferred to the probe 110 is transferred from the probe 110 via the excitation power to the Peltier junctions 910.

The above embodiments are the preferred embodiments, but this invention is not limited thereto, nor to the figures and examples given above. It is, therefore, apparent that many modifications and variations of the present invention are possible in light of the above teachings. It is, therefore, to be understood that within the scope of the appended claims, the invention may be practiced otherwise than as specifically described.

The invention claimed is:

1. An apparatus for reducing a temperature of a fluid, the apparatus comprising:

(a) a probe at a probe average temperature, said probe being disposable into the fluid;

(b) a fluid temperature comprising an average temperature of the fluid;

(c) a cooling system to remove heat from the probe while heat is transferred from the fluid to the probe;

(d) a sleeve, disposable over the probe, to keep the liquid from direct contact to the probe; and (e) wherein said sleeve is a disposable sleeve.

2. The apparatus of claim 1 wherein the cooling system comprises a refrigeration system.

3. The apparatus of claim 1 additionally comprising a sensor to sense a presence of the fluid.

4. The apparatus of claim 1 additionally comprising:

(a) a sensor to sense the fluid temperature; and (b) a display to display an indication of the fluid temperature.

5. The apparatus of claim 1 additionally comprising:

(a) a sensor to sense the fluid temperature; and (b) a logic system to cause the cooling system to remove heat from the probe when the sensor senses the fluid is present.

* * * * *